US008850717B2

(12) United States Patent
Lin

(10) Patent No.: US 8,850,717 B2
(45) Date of Patent: Oct. 7, 2014

(54) ESSENCE-REPLACEABLE, VENTILATIVE, AND RELEASABLE SHOE

(76) Inventor: Ming-Han Lin, New Taipei (TW)

( * ) Notice: Subject to any disclaimer, the term of this patent is extended or adjusted under 35 U.S.C. 154(b) by 373 days.

(21) Appl. No.: 13/418,358

(22) Filed: Mar. 13, 2012

(65) Prior Publication Data

US 2013/0239443 A1 Sep. 19, 2013

(51) Int. Cl.
*A43B 7/06* (2006.01)

(52) U.S. Cl.
USPC ..... 36/3 R; 36/3 B; 36/29

(58) Field of Classification Search
USPC ..... 36/3 R, 3 A, 3 B, 29
See application file for complete search history.

(56) References Cited

U.S. PATENT DOCUMENTS 426,495 A * 4/1890 Falkner ..... 36/3 R
466,061 A * 12/1891 Locke ..... 36/3 R
607,289 A * 7/1898 Stayert ..... 36/3 R
2,474,815 A * 7/1949 Brahm ..... 36/3 B
3,335,505 A * 8/1967 Stec ..... 36/3 B
3,475,836 A * 11/1969 Brahm ..... 36/3 R
3,716,930 A * 2/1973 Brahm ..... 36/3 B
6,463,679 B1 * 10/2002 Buttigieg ..... 36/3 B
7,493,706 B2 * 2/2009 Cho et al. ..... 36/3 R
2004/0010939 A1 * 1/2004 Liu et al. ..... 36/29
2011/0167679 A1 * 7/2011 Graziani et al. ..... 36/3 R
2011/0265352 A1 * 11/2011 Lin ..... 36/3 B

* cited by examiner

*Primary Examiner* — Marie Bays
(74) *Attorney, Agent, or Firm* — Leong C. Lei

(57) ABSTRACT

An essence-replaceable, ventilative, and releasable shoe includes a shoe body, which includes an outsole layer, a midsole layer, an insole layer, and a vamp, and an air bladder, which is arranged between the midsole layer and the insole layer. The air bladder includes an absorbent member arranged therein. The air bladder is connected with an air tube that has a discharge opening located between the midsole layer and the insole layer. The absorbent member inside the air bladder may absorb and hold therein an essential oil so that when a user wearing the shoe walks and compresses the air bladder; the air bladder generates an airflow that carries aromatic particles of the essential oil to flow through the air tube to be discharged to the foot of the user thereby realizing ventilation and deodorization with the aromatic smell of the essential oil.

8 Claims, 9 Drawing Sheets

ESSENCE-REPLACEABLE, VENTILATIVE, AND RELEASABLE SHOE

TECHNICAL FIELD OF THE INVENTION

The present invention generally relates to an essence-replaceable, ventilative, and releasable shoe, and more particularly to a shoe sole comprising an air bladder that contains an absorbent structure absorbing an essential oil so that when air or gas is expelled out of the air bladder, the aromatic particles of the absorbed essential oil are simultaneously carried out by the air to spread around the shoe in order to realize, at the same time, ventilation and deodorization.

DESCRIPTION OF THE PRIOR ART

Conventional shoes are generally incapable of air ventilation so that when they are worn for a long while, the feet that wear the shoes become uncomfortable or get sweating due to the increased temperature, making the interior of the shoes full of odor smells and bacteria and thus affecting sanitary.

Due to such a problem, breathable or ventilative shoes are available in the market. Such a shoe often comprises an air bladder so that when a user is walking, the air bladder is repeatedly compressed to generate airflows, which are allowed to flow around the interior of the shoe so as to realize ventilation.

However, the conventional shoes still suffer the following disadvantages:

(1) Such forced airflows generated by the air bladder cannot be conveyed to a specific site inside the shoe, for example an end site that is far from the air bladder, and the airflows only circulate around the neighboring area of the air bladder without being properly spread to the whole interior of the shoe, thereby providing only very limited or reduced effect of ventilation.

(2) For long term use, the feet of a user are enclosed in the shoes for a long time and odor smells are inevitably generated, so that when the user takes off the shoes, the smell may spread around, causing an embarrassing situation.

The present invention aims to provide an essence-replaceable, ventilative, and releasable shoe to overcome the above discussed problems.

SUMMARY OF THE INVENTION

The object of the present invention is to provide an essence-replaceable, ventilative, and releasable shoe, which comprises a shoe body, which comprises an outsole layer, a midsole layer, an insole layer, and a vamp, and an air bladder, which is arranged between the midsole layer and the insole layer. The air bladder comprises an absorbent member arranged therein. The air bladder may be removed for replacement or repeated filling of essential. The air bladder forms air passage holes to connect with air tubes. The air tubes have discharge openings that are located between the midsole layer and the insole layer. In this way, the absorbent member arranged inside the air bladder may absorb an essential oil, so that when a user walks and thus compresses the air bladder, the air bladder generates an airflow that carries aromatic particles of the essential oil contained in the absorbent member and flows through the air tubes to get into and spread around the space between the midsole layer and the insole layer for subsequently discharging upward through the insole layer to reach the foot of a user thereby realizing ventilation and deodorization of the shoe.

The absorbent member contained in the air bladder is a substance that absorbs and holds an essential oil therein, such as sponge or cotton or fabric. The present invention imposes no limitation to the material of the absorbent member. The air bladder according to the present invention may selectively comprise an absorbent member that contains different aromatic smells and the air bladder can thus serve as a "perfume pack" to allow a user to change air bladders of different smells or filling various additives therein according to his or her preference to thereby meet different needs.

The air bladder comprises a filling hole, over which a coupler is fit. The coupler has a top opening, which is set in alignment with an aperture of the insole layer. A plug is provided to normally block the opening of the coupler. In this way, a user may remove the plug to feed the essential oil to the filling hole of the air bladder so that the essential oil is absorbed by the absorbent member and the absorbent member can thus be supplemented with essential oil.

An accommodation chamber is formed between the midsole layer and the insole layer to snugly receive the air bladder therein. Further, the insole layer and the midsole layer may be fixed together with a hook-and-loop fastener arranged therebetween in order to secure the air bladder between the insole layer and the midsole layer.

The present invention further comprises a retention seat, which comprises two plates. The two plates are respectively provided with retention pegs and the retention holes that engage each other to secure the two plates around a circumference of the air bladder. The two plates of the retention seat are also respectively fixed to the insole layer and the midsole layer to secure the air bladder between the two plates of the retention seat.

The midsole layer may be sized to completely cover an undersurface of the insole layer or only partially cover the undersurface of the insole layer. The present invention does not impose any constraint to the size and shape of the midsole layer.

The outsole layer has a shoe heel which has a side wall forming a bore, which communicates with an air channel between the midsole layer and the insole layer. The bore receives therein a one-way valve, whereby heated air inside the shoe can be expelled outside the shoe through the one-way valve, but rain water outside the shoe is blocked by the one-way valve from entering the shoe. The one-way valve comprises a tube, which movably receives therein a ball and is threadingly fit to an adjusting bar with a spring provided between the ball and the adjusting bar, whereby rotating the adjusting bar may adjust the force that the ball applies against an outlet opening of the tube so that the force required for activation of the one-way valve is adjusted.

The air bladder can be connected to a plurality of air tubes and the discharge openings of the air tubes may be distributed under the insole layer so that the airflows generated by the compression of the air bladder may be guided to and spread over various locations under the insole layer to realize supply of air in a totally covering manner.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
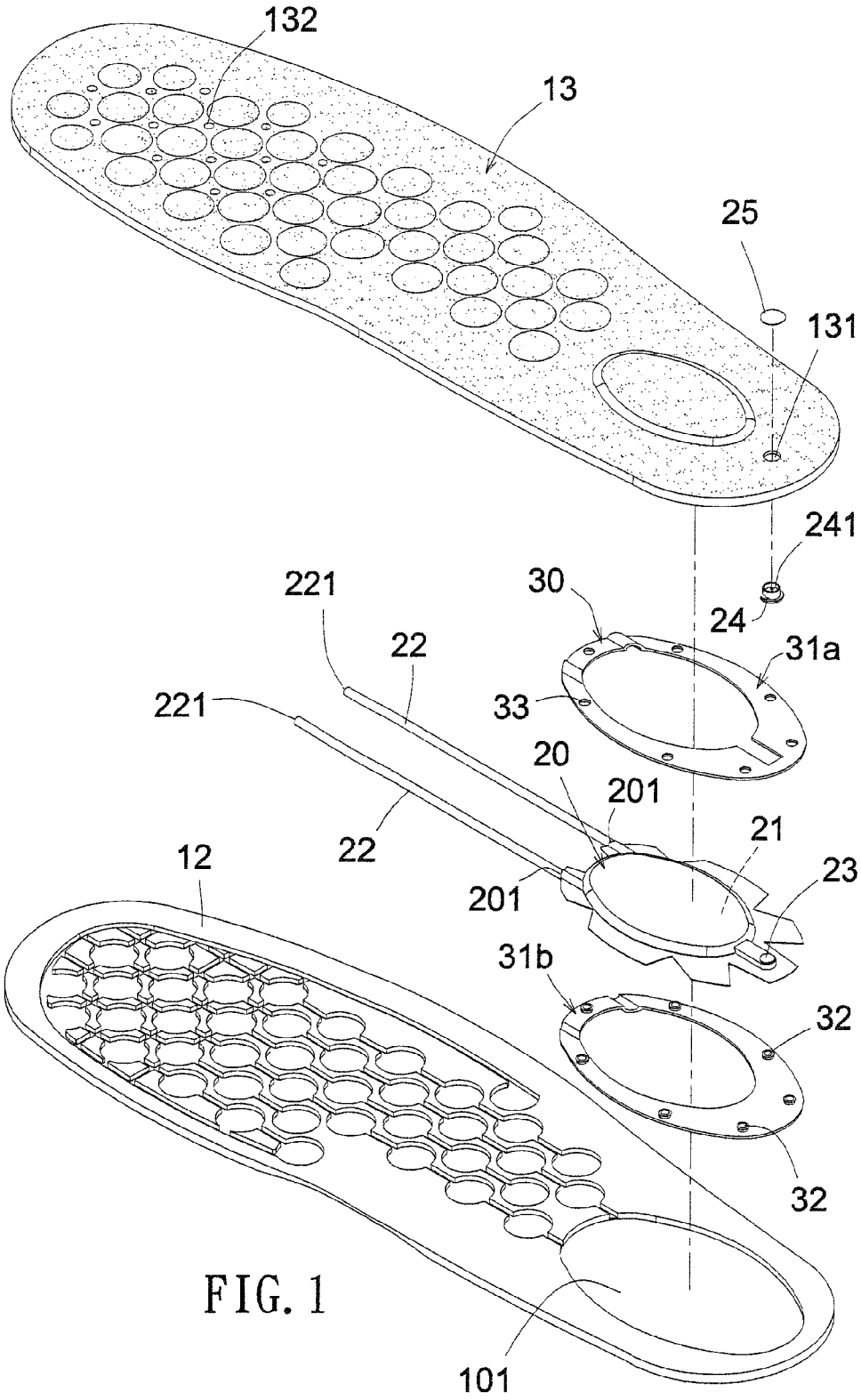
FIG. 1 is a perspective view showing a midsole layer, an insole layer, and the air bladder to be assembled together according to the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1, 2, 3, 4, 5, and 6, the present invention relates to an essence-replaceable, ventilative, and releasable shoe, which comprises: a shoe body 10, which comprises an outsole layer 11, a midsole layer 12, an insole layer 13, and a vamp 14, and an air bladder 20, which is arranged between the midsole layer 12 and the insole layer 13. The air bladder 20 comprises an absorbent member 21 arranged therein. The air bladder 20 forms air passage holes 201 to connect with air tubes 22. The air tubes 22 have discharge openings 221 that are located between the midsole layer 12 and the insole layer 13. In this way, the absorbent member 21 arranged inside the air bladder 20 may absorb therein an essential oil, so that when a user walks and thus compresses the air bladder 20, the air bladder 20 generates an airflow that carries the essential oil contained in the absorbent member 21 and flows through the air tubes 22 to get into the space between the midsole layer 12 and the insole layer 13 for subsequently discharging upward through air holes 132 formed in the insole layer 13 to reach the foot of a user thereby realizing ventilation and deodorization of the shoe.

The absorbent member 21 contained in the air bladder 20 is a substance that absorbs and holds an essential oil therein, such as sponge or cotton or fabric. The present invention imposes no limitation to the material of the absorbent member 21. The air bladder 20 according to the present invention may selectively comprise an absorbent member 21 that contains different aromatic smells and the air bladder 20 can thus serve as a "perfume pack" to allow a user to change air bladders 20 of different smells according to his or her preference. Or, after the aromatic smell of the absorbent member 21 is completely consumed, a user may fill an essential oil of different smell in order to release different aromatic smells in the shoe.

As shown in FIGS. 1, 4, 5, and 6, the air bladder 20 comprises a filling hole 23, over which a coupler 24 is fit. The coupler 24 has a top opening 241, which is set in alignment with an aperture 131 of the insole layer 13. A plug 25 is provided to normally block the opening 241 of the coupler 24. In this way, a user may remove the plug 25 to feed the essential oil to the filling hole 23 of the air bladder 20, as indicated by arrow R shown in FIG. 6, so that the essential oil is absorbed by the absorbent member 21 and the absorbent member 21 can thus be supplemented with essential oil. As such, when the essential oil contained in the air bladder 20 is completely consumed, the essential oil can be properly supplemented without completely replacing the air bladder 20, making it economic and environmentally conservative. The filling hole 23 may be an integral portion of a plastic film that constitutes the air bladder 20 and a user may uses a cutter to cut and thus open it to form the filling hole 23.

Further, in supplementing the essential oil or other additives into the air bladder 20, the air tubes 22 may be detached from the air passage holes 201 of the air bladder 20, so that the essential oil or the other additives can be filled through the air passage holes 201.

Figure 8:
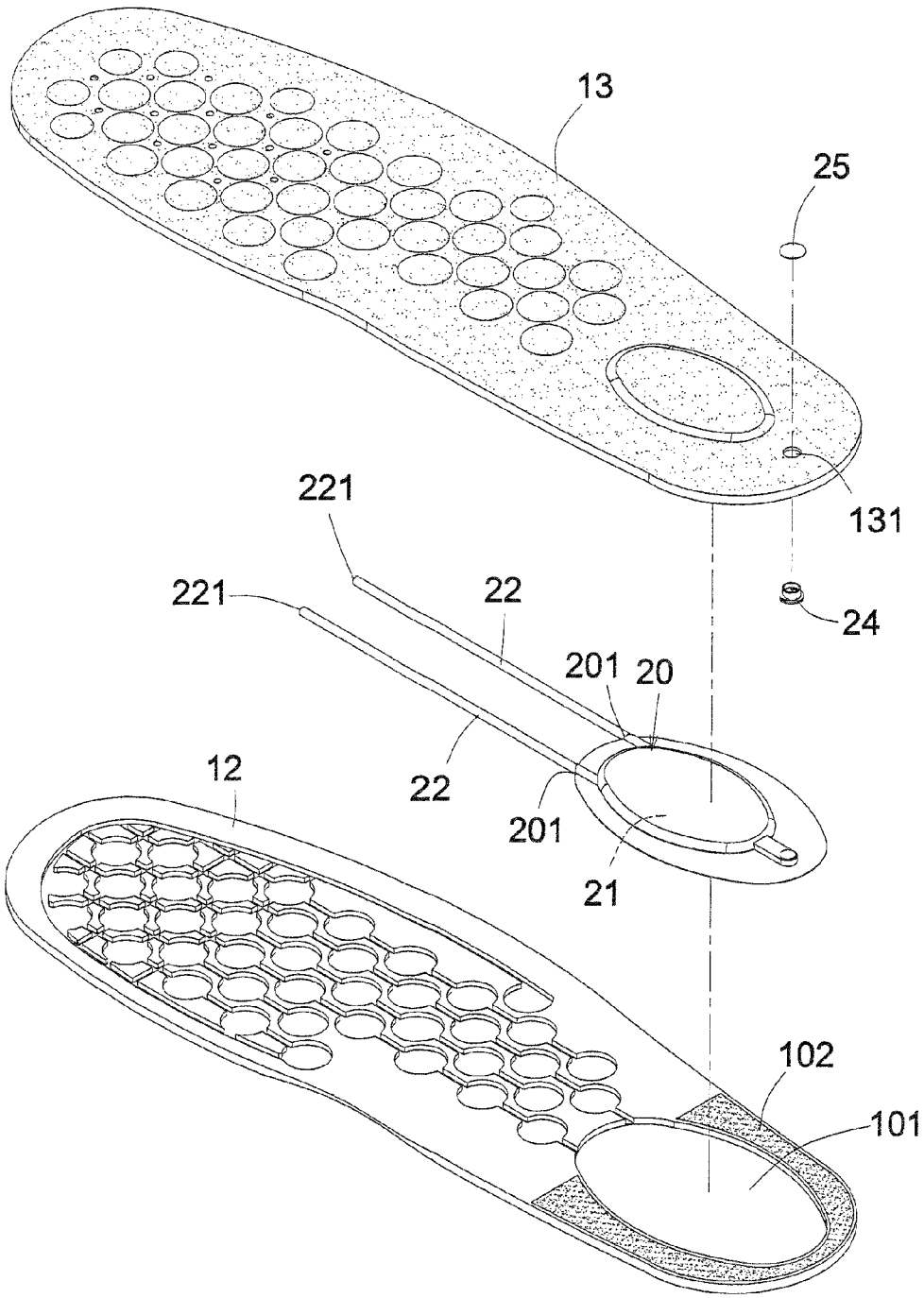
FIG. 8 is a perspective view showing a midsole layer, an insole layer, and the air bladder to be assembled together according to a second embodiment of the present invention.

As shown in FIG. 8, an accommodation chamber 101 is formed between the midsole layer 12 and the insole layer 13 to snugly receive the air bladder 20 therein. Further, the insole layer 13 and the midsole layer 12 may be fixed together with a hook-and-loop fastener 102 arranged therebetween in order to enclose and secure the air bladder 20 between the insole layer 13 and the midsole layer 12.

Figure 2:
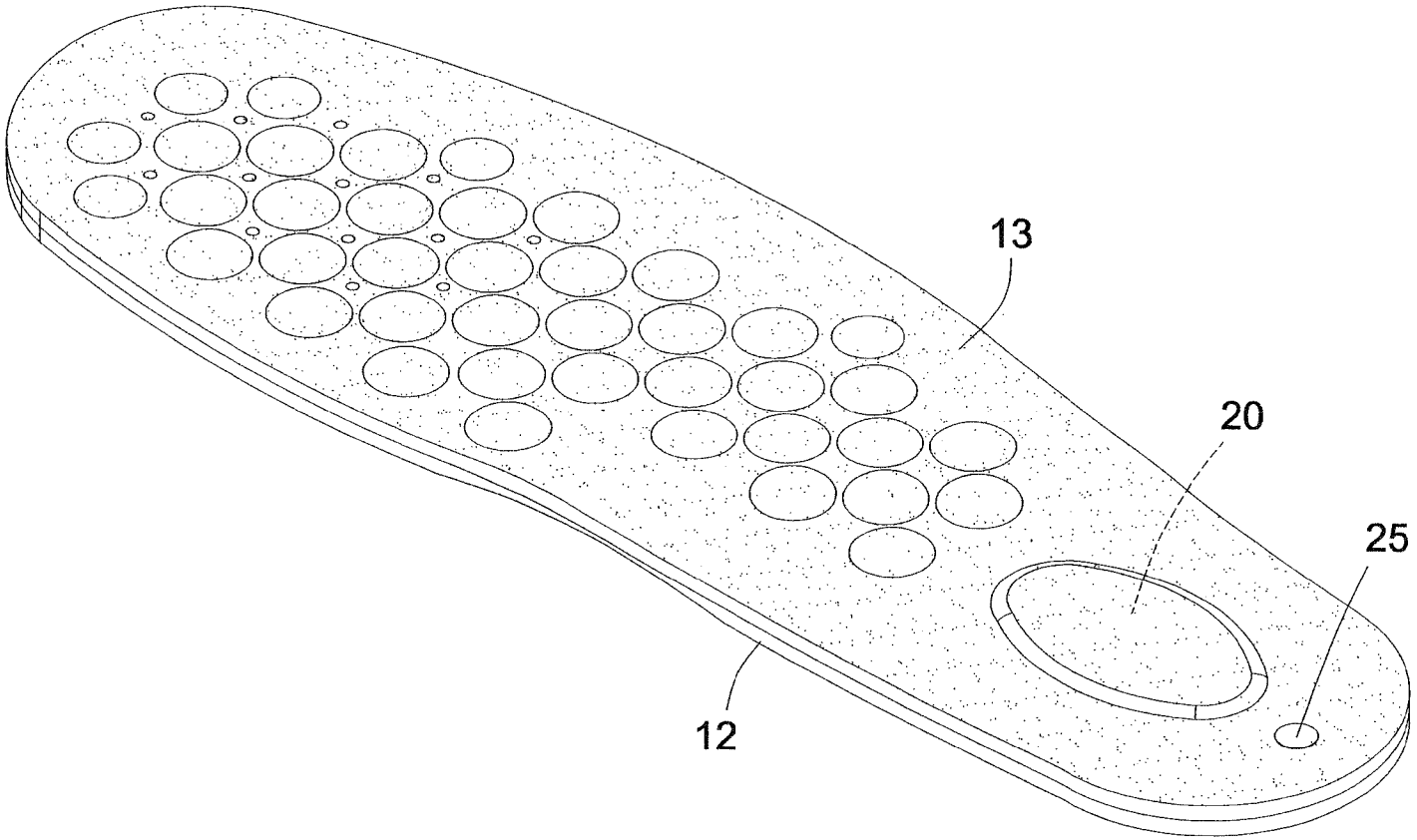
FIG. 2 is a perspective view of the embodiment shown in FIG. 1 in an assembled form.
Figure 3:
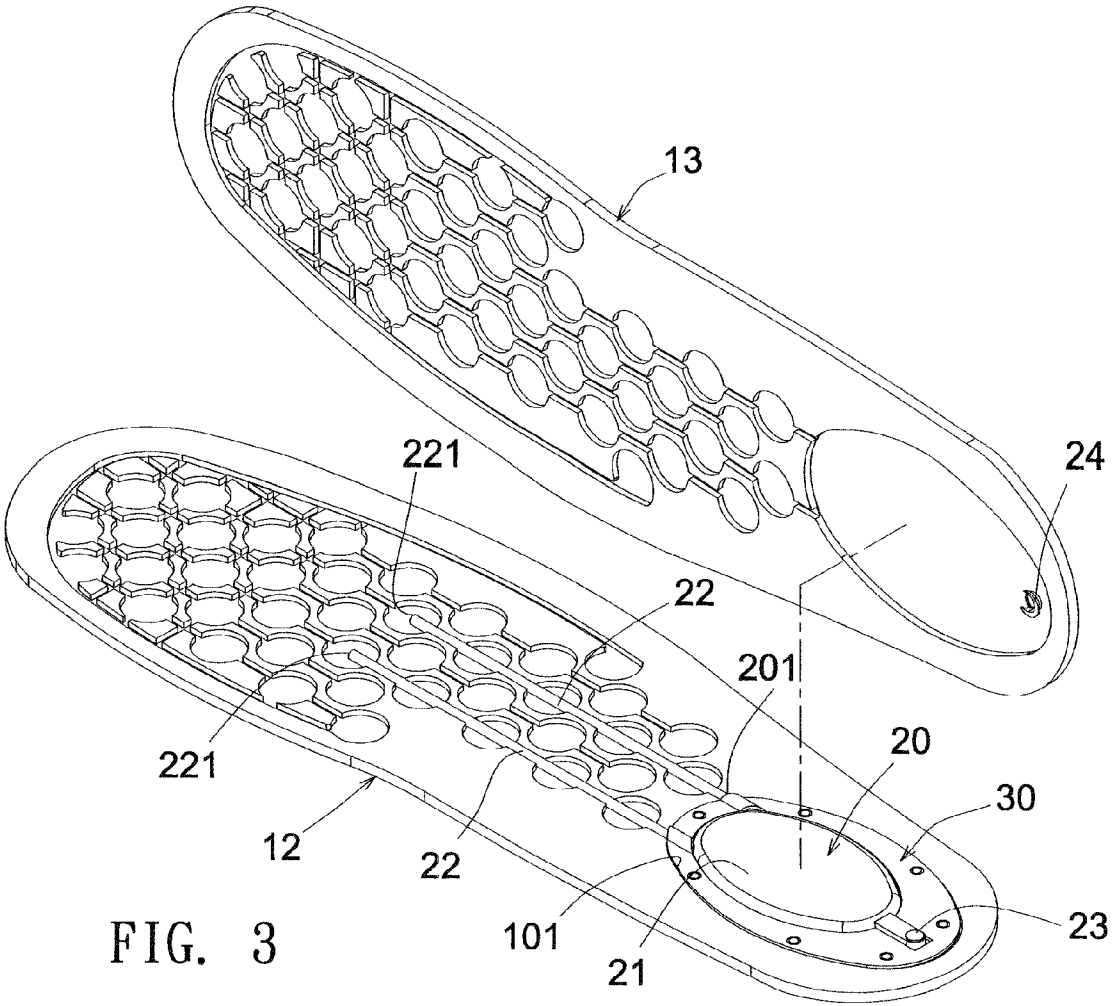
FIG. 3 is a perspective view showing the insole layer of FIG. 2 is lifted.
Figure 4:
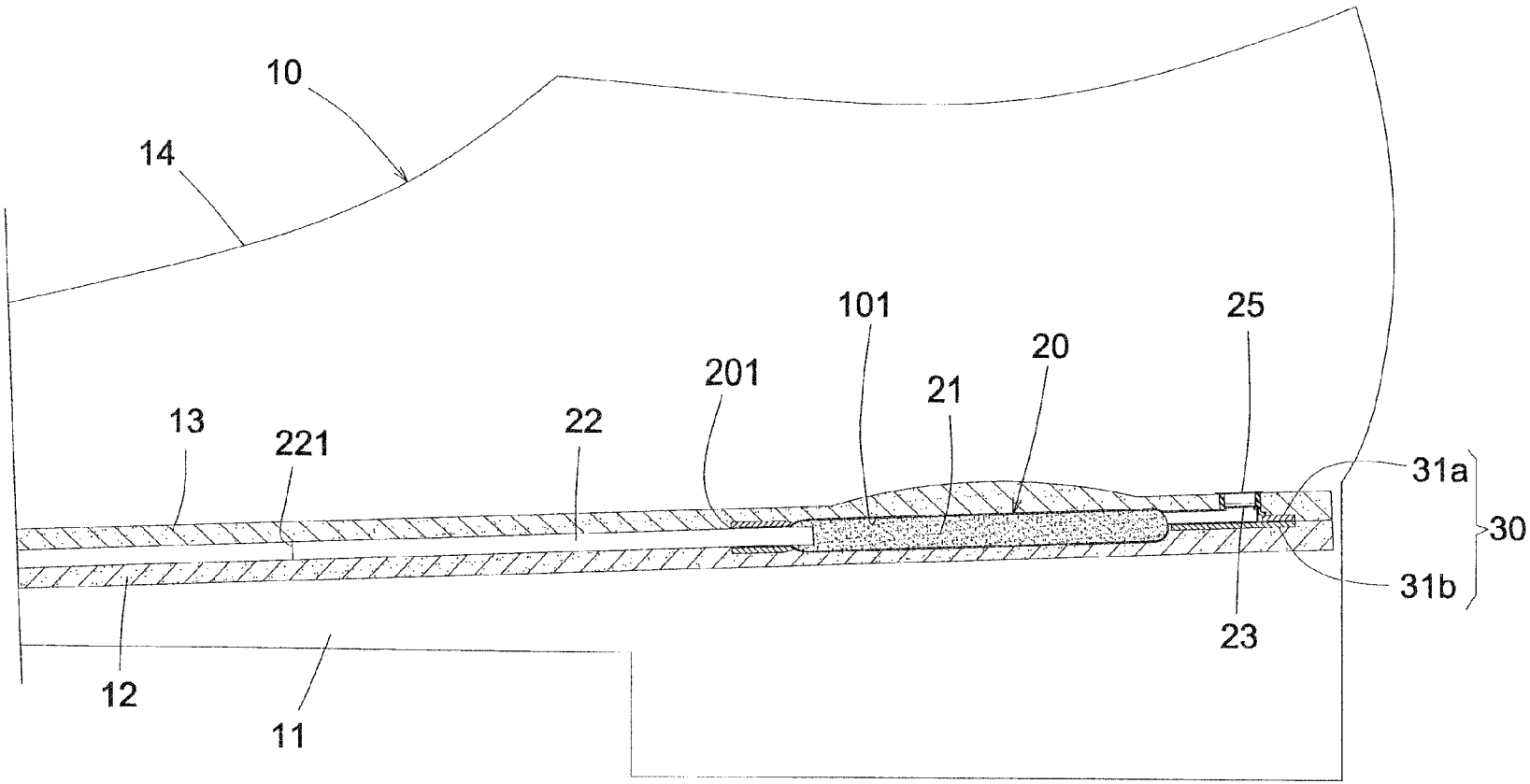
FIG. 4 is a longitudinal cross-sectional view of a shoe in which the present invention is embodied.
Figure 5:
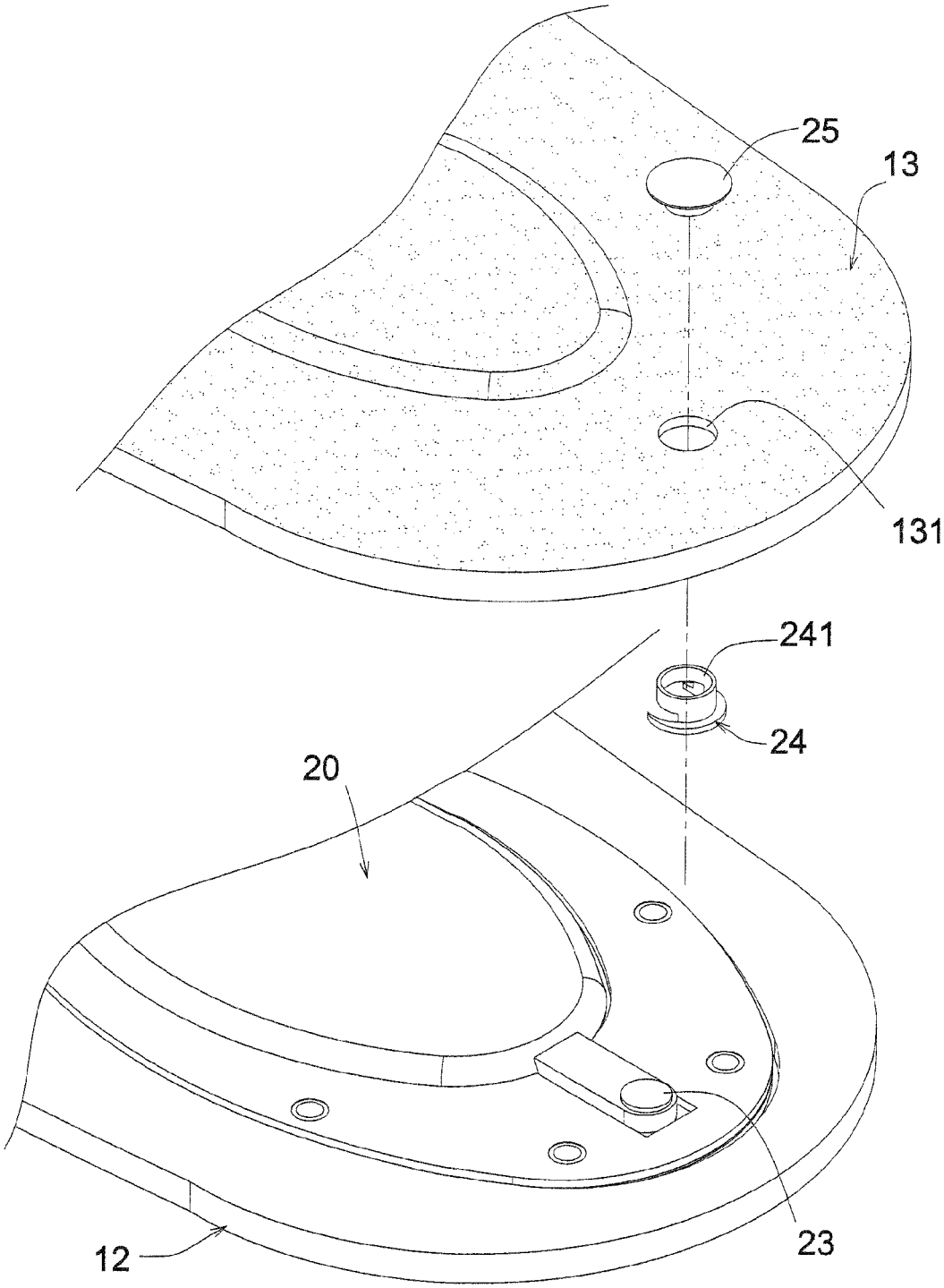
FIG. 5 is a perspective view showing spatial relationship among a plug, a coupler, and a filling hole of the air bladder according to the present invention.
Figure 6:
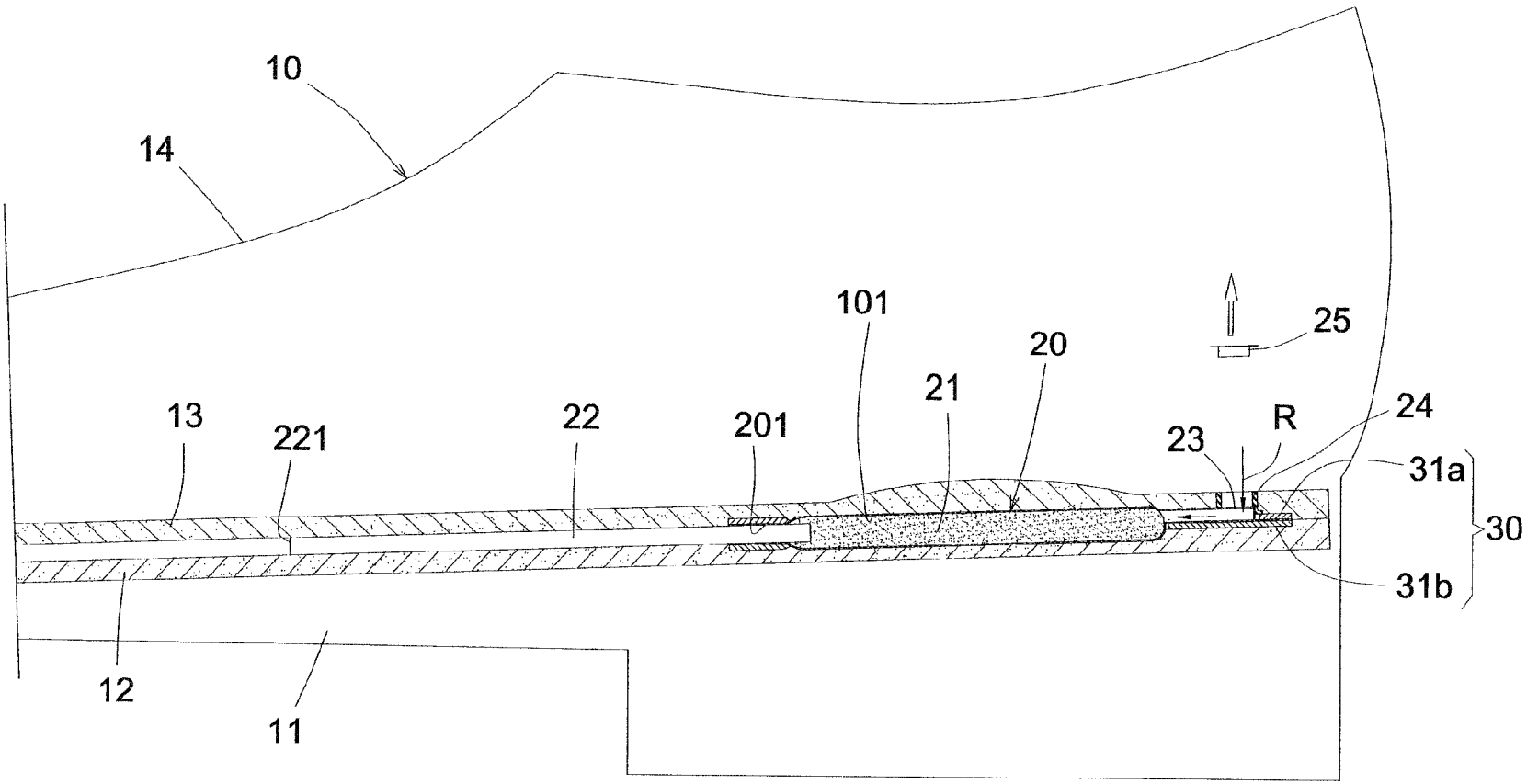
FIG. 6 illustrates an operation of filling essential oil with the plug being removed from that shown in FIG. 4.

As shown in FIGS. 1, 2, and 3, the present invention further comprises a retention seat 30, which comprises two plates 31*a*, 31*b*. The two plates 31*a*, 31*b* are respectively provided with retention pegs 32 and the retention holes 33 that engage each other to secure the two plates around a circumference of the air bladder 20. The two plates 31*a*, 31*b* of the retention seat 30 are also respectively secured to the insole layer 13 and the midsole layer 12.

Figure 9:
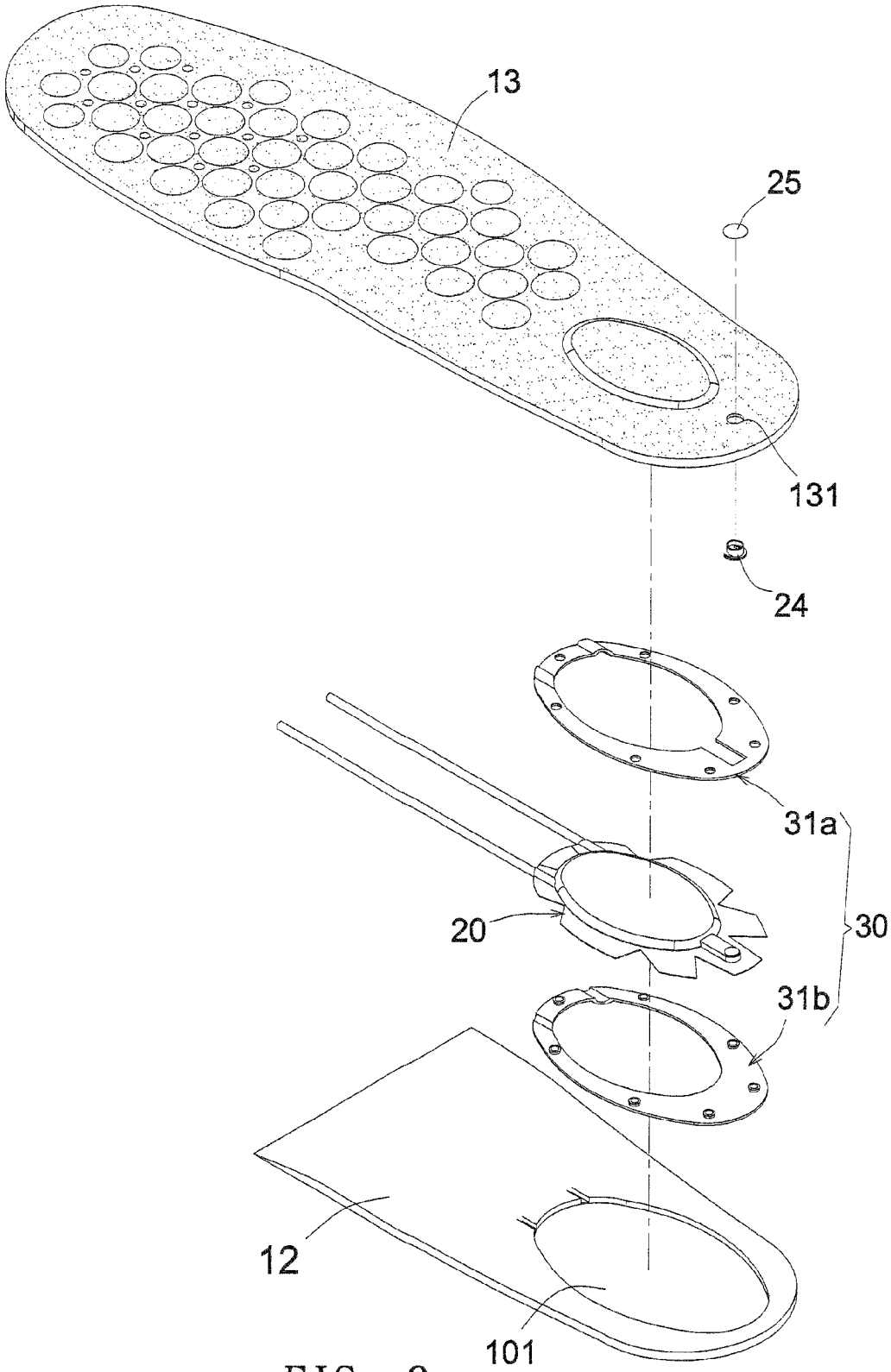
FIG. 9 is a perspective view showing a third of the present invention to be assembled.

The midsole layer 12 may be sized to completely cover an undersurface of the insole layer 13 or alternatively, as shown in FIG. 9, the midsole layer 12 only partially cover a portion of the undersurface of the insole layer 13. The present invention does not impose any constraint to the size and shape of the midsole layer 12.

Figure 7:
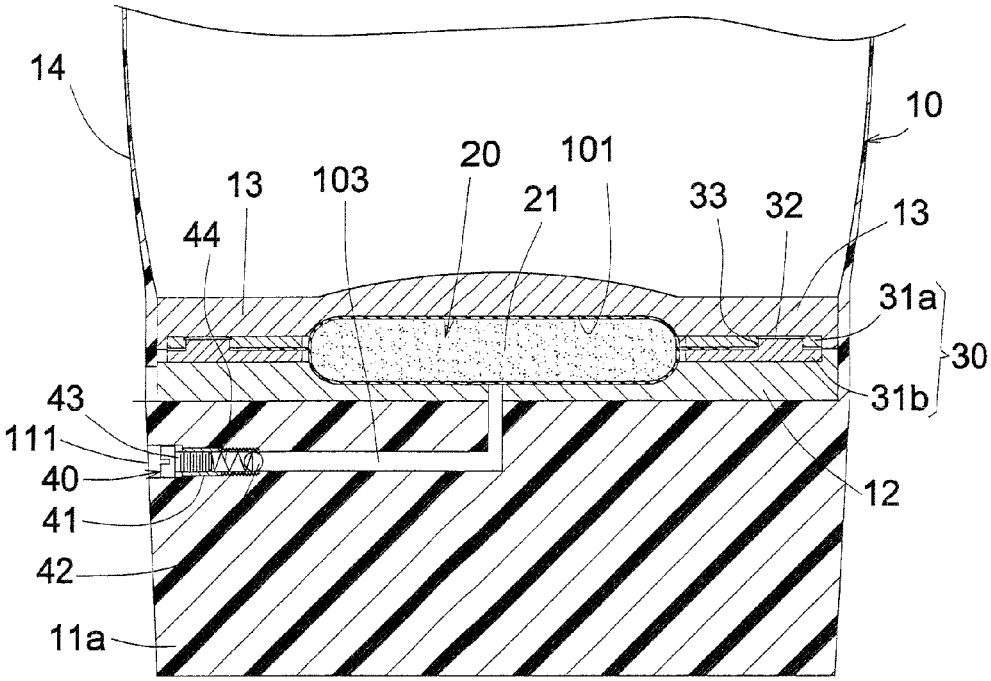
FIG. 7 is lateral cross-sectional view of the shoe to which the present invention is embodied.

As shown in FIG. 7, according to the present invention, the outsole layer 11 has a shoe heel 11*a* which has a side wall forming a bore 111, which communicates with an air channel 103 between the midsole layer 12 and the insole layer 13. The bore 111 receives therein a one-way valve 40, whereby heated air inside the shoe can be expelled outside the shoe through the one-way valve 40, but rain water outside the shoe is blocked by the one-way valve 40 from entering the shoe. The one-way valve 40 comprises a tube 41, which has a first end in which a ball 42 is movably received and a second end receiving an adjusting bar 43 screwed therein. A spring 44 is provided between the ball 42 and the adjusting bar 43, whereby rotating the adjusting bar 43 may adjust the force that the ball 42 applies against the first end of the tube 41 so that the force required for activation of the one-way valve 40 is adjusted.

The air bladder 20 can be connected to a plurality of air tubes 22, and the present invention does not set any constraint to the number of the air tubes 22 used. The discharge openings 221 of the air tubes 22 may be distributed under the insole layer 13 so that the airflows generated by the compression of the air bladder 20 may be guided to various locations under the insole layer 13 to realize supply of air in a totally covering manner.

The features of the present invention are that the air bladder 20 comprises therein the absorbent member 21 that absorbs and holds an essential oil and the airflows generated by the air bladder 20 are allowed to carry the aromatic particles released from the essential oil to be spread to various corners of the shoe to realize ventilation and deodorization.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An essence-replaceable, ventilative, and releasable shoe, comprising:

a shoe body, which comprises an outsole layer, a midsole layer, an insole layer, and a vamp; and an air bladder, which is arranged between the midsole layer and the insole layer, the air bladder comprising an absorbent member arranged therein, the air bladder forming an air passage hole to connect with an air tube in such a way that a discharge opening of the air tube is located between the midsole layer and the insole layer;

wherein an accommodation chamber is formed between the midsole layer and the insole layer to receive the air bladder therein, the insole layer and the midsole layer being coupled to each other by a hook-and-loop fastener.

2. The essence-replaceable, ventilative, and releasable shoe according to claim 1, wherein the absorbent member of the air bladder comprises sponge, cotton, or fabric.

3. The essence-replaceable, ventilative, and releasable shoe according to claim 1, wherein the air bladder forms a filling hole, over which a coupler is fit in such a way that an opening of the coupler is in alignment with an aperture of the insole layer, a plug normally blocking the opening of the coupler.

4. The essence-replaceable, ventilative, and releasable shoe according to claim 1, further comprising a retention seat, which comprises two plates, which are respectively provided with retention pegs and retention holes engageable with each other to secure the retention seat around a circumference of the air bladder, the two plates of the retention seat being respectively fixed to the insole layer and the midsole layer.

5. The essence-replaceable, ventilative, and releasable shoe according to claim 1, wherein the midsole layer is arranged to completely cover an undersurface of the insole layer.

6. The essence-replaceable, ventilative, and releasable shoe according to claim 1, wherein the midsole layer is arranged to partially cover an undersurface of the insole layer.

7. The essence-replaceable, ventilative, and releasable shoe according to claim 1, wherein the outsole layer has a side wall in which a bore is defined in such a way that the bore communicates with an air channel formed between the midsole layer and the insole layer, a one-way valve being arranged in the bore.

8. The essence-replaceable, ventilative, and releasable shoe according to claim 7, wherein the one-way valve comprises a tube, which has a first end movably receiving therein a ball and a second end threadingly fit to an adjusting bar, a spring being arranged between the ball and the adjusting bar.

* * * * *